US005339858A

United States Patent [19]

Giles

[11] Patent Number: 5,339,858

[45] Date of Patent: Aug. 23, 1994

[54] DEVICE FOR RESTORING A FLUID LEVEL IN A FLUID RECEPTACLE

[75] Inventor: Alan B. Giles, Laurel, Md.

[73] Assignee: Spurion Technology Pty. Ltd., Cambridge, Australia

[21] Appl. No.: 96,691

[22] Filed: Jul. 23, 1993

[30] Foreign Application Priority Data

Aug. 4, 1992 [AU] Australia ..... PL3915

[51] Int. Cl.[5] ..... F04F 10/02

[52] U.S. Cl. ..... 137/130; 137/453; 137/571; 137/590

[58] Field of Search ..... 137/130, 261, 453, 571, 137/590

[56] References Cited

U.S. PATENT DOCUMENTS

| | | | |
|---|---|---|---|
| 1,935,159 | 11/1933 | Mokler | 137/453 |
| 2,059,716 | 11/1936 | Swinburne | 137/130 X |
| 2,685,303 | 8/1954 | Tolley | 137/453 X |
| 2,979,161 | 4/1961 | Lyden | 137/453 X |
| 3,486,525 | 12/1969 | Carpigiani | 137/453 |
| 3,487,847 | 1/1970 | Scott | 137/453 X |
| 3,941,147 | 3/1976 | Kaup et al. | 137/453 |

FOREIGN PATENT DOCUMENTS

| | | | |
|---|---|---|---|
| 147682 | 8/1952 | Australia . | |
| 537940 | 7/1984 | Australia . | |
| 8538938 | 2/1985 | Australia . | |
| 821686 | 10/1951 | Fed. Rep. of Germany | 137/453 |
| 397857 | 8/1933 | United Kingdom | 137/453 |

*Primary Examiner*—John Rivell
*Attorney, Agent, or Firm*—Ladas & Parry

[57] ABSTRACT

The invention provides a device for restoring a fluid level in a fluid receptacle to a predetermined level when the fluid level falls below the predetermined level, said device including: a closed vessel for containing a fluid supply, the vessel having an aperture allowing the fluid supply to be in communication with fluid in the fluid receptacle, and an air inlet tube extending into the vessel; wherein, in use, the inlet tube is positioned such that air is drawn into the vessel when the level in the fluid receptacle falls below the predetermined level thereby allowing fluid to pass through the aperture into the fluid receptacle until the fluid level is restored.

8 Claims, 2 Drawing Sheets

DEVICE FOR RESTORING A FLUID LEVEL IN A FLUID RECEPTACLE

The present invention relates to fluid receptacles, in particular devices for maintaining a fluid level in a fluid receptacle. The device according to the invention is especially suitable for use with bird baths or drinking water containers or troughs for stock-yard animals or domestic pets, and it will be convenient to hereinafter describe the invention in relation to this type of application. However, it is to be understood that the present invention may be used to maintain fluid levels in other types of fluid receptacles.

BACKGROUND OF THE INVENTION

Devices for maintaining water levels in water containers for stock yard animals are known, however these devices generally operate using valves and ballcocks. These devices, which usually operate under mains pressure or tank pressure, suffer from a disadvantage that the valves often become blocked or leak or that the ballcock floatation mechanism breaks down and fails to function effectively.

Other devices are known which rely on a partial vacuum created in an upturned water container to control the supply of water to the water receptacle. These vacuum operated devices suffer from the disadvantage that they must be upturned while full of water. Accordingly the size of such containers is limited.

Australian patent number 147,682 is an attempt to overcome the fundamental requirement of inverting the container in systems where the water reservoir is maintained by vacuum. The design of the watering device allows the vessel to be filled without inversion, however, since the top of the outer container is not an airtight seal, water in the small annular gap between the inner and outer vessels is free to dribble out of the small outlet orifice regardless of its level in the lower dish. This will, as stated, block the lower end of the tube preventing air inflow by this path but as this water drains through the orifice it will eventually allow an airpath under the bottom of the inner container.

Accordingly it appears that all water would slowly drain out of the inner vessel and the lower dish continuously overflow unless the outlet orifice is raised in height from that suggested in the patent. The patent also specifies that the air inlet tube must extend substantially vertically from the open topped receptacle into the vessel containing the liquid supply. Accordingly the device suffers from the disadvantage that the vessel containing the liquid supply must be located substantially vertically above the open topped receptacle.

In all known devices of the type in which the water reservoir is maintained by partial vacuum the vessel containing the water supply is necessarily located within, or in close proximity to, the water receptacle. Generally the vessel containing the water supply and the water receptacle are manufactured as a single unit. As such both the vessel and the receptacle are located inside the animal or bird enclosure and it is necessary to enter the enclosure when the water vessel is to be refilled. It would be convenient to provide a device which could be located outside the enclosure or at least in a position remote from the water receptacle.

It is an object of the present invention to overcome or at least alleviate one or more of the above mentioned disadvantages of the prior art.

BRIEF SUMMARY OF THE INVENTION

Accordingly the invention provides a device for restoring a fluid level in a fluid receptacle to a predetermined level when said fluid level falls below said predetermined level, said device including:

a closed vessel for containing a fluid supply, said vessel having an aperture allowing said fluid supply to be in communication with fluid in said fluid receptacle, and an air inlet tube extending into said vessel;

wherein, in use, the inlet tube is positioned such that air is drawn into the vessel when said level in the fluid receptacle falls below said predetermined level thereby allowing fluid to pass through the aperture into the fluid receptacle until the fluid level is restored.

The vessel may be any convenient shape and may be composed of any material capable of maintaining the fluid supply in an airtight condition while the fluid level in the fluid receptacle is at or above the predetermined level. Suitable materials include, but are not limited to, plastics such as polyvinyl chloride, polyester, nylon, polypropylene etc, metals such as copper, brass, or stainless steel; glass; ceramic etc.

The fluid supply in the vessel communicates with the fluid in the fluid receptacle through an aperture which is preferably located in the bottom region of the vessel. The aperture in the vessel may open directly into the fluid receptacle or a hose, tube or other conduit may be connected at the aperture in an airtight manner to allow fluid to pass from the vessel into the fluid receptacle. The conduit connecting the vessel to the fluid receptacle should be arranged in such a way that it does not allow air to pass into the vessel during operation of the device.

The air inlet tube may be positioned to pass into the vessel in such a way that the passage of air through the tube is blocked by the fluid in the vessel when the fluid in the fluid receptacle is at or above the predetermined level. In an embodiment of the invention the air inlet tube has an inlet open to the atmosphere outside the vessel and an outlet open to the inside of the vessel. The device according to this embodiment may be positioned relative to the receptacle such that the outlet defines the predetermined level in the fluid receptacle. This may be achieved by positioning the uppermost portion of the outlet at the predetermined level. The device is positioned in this way so that, when the fluid level in the receptacle is at or above the predetermined level, the passage of air into the vessel through the outlet is blocked by the fluid supply in the vessel, thereby maintaining a partial vacuum inside the vessel preventing the flow of fluid from the vessel to the receptacle. This positioning of the device may also allow air to pass into the vessel through the outlet when the fluid level in the receptacle falls below the predetermined level, thereby allowing fluid to pass through the aperture into the fluid receptacle until the fluid level is restored to the predetermined level. In order to operate effectively the uppermost portion of the air opening should be above the aperture leading to the fluid receptacle.

In one embodiment a straight length of tube passes through the roof of the fluid vessel and extends vertically downwards towards the bottom of the vessel. In this embodiment the lower end of the air inlet tube defines the outlet. The lower end of the air inlet tube may terminate in a transverse or oblique cut to provide the outlet. In another embodiment the outlet is provided in the side of a downwardly extending portion of the air inlet tube.

The device will also operate effectively if the air inlet tube is passed through a side wall of the vessel rather than the roof of the vessel. In this case it is possible to use a shorter air inlet tube.

The air inlet tube may be formed integrally with the wall or roof of the vessel or may be fixed to the vessel in an airtight manner. In another embodiment the position of the tube opening inside the vessel is adjustable which allows adjustment of the predetermined fluid level. This adjustment may be achieved by passing the air inlet tube through a hole in the vessel which is fitted with a sealing device such as an O-ring. Sliding the air inlet tube through the O-ring allows the predetermined fluid level to be adjusted.

To operate the device it is first necessary to fill the vessel with a fluid supply. The vessel may be filled through the air inlet tube or through the aperture leading to the fluid receptacle. When filling the device through the air inlet tube the air in the vessel is allowed to escape through the aperture leading to the fluid receptacle. To fill the vessel in this manner the vessel should be orientated such that the aperture is on the upper side and open to the atmosphere. The vessel is then filled through the air inlet tube until fluid begins to emerge from the aperture. The device is carried to its operating location, if necessary, connected to the fluid receptacle and rotated to the vertical for operation.

To fill the device through the aperture leading to the fluid receptacle the device is orientated such that the aperture points upwards and is filled through the aperture until fluid begins to emerge from the air inlet tube. The filling of the vessel in this manner is facilitated if the air inlet tube is located on a side of the vessel near the aperture or if the air inlet tube passes out of the vessel on the same side as the aperture.

The filling process can also be facilitated by fitting the aperture and or the outer opening of the air inlet tube with hose connectors. This allows the vessel to be rapidly filled from a hose.

To avoid the need to carry the device to its operating location and to facilitate rotation of the device during the filling operation the device may be mounted in its operating location on a rotating support so that the device may be rotated in situ when it is to be filled.

During operation the device may be located in the fluid receptacle or is preferably located remote from the fluid receptacle, being connected to the fluid receptacle via a conduit extending from the aperture in the vessel.

In a further embodiment of the invention the device is provided with a further tube, hereinafter referred to as a "snorkel tube", which performs the following two functions. Firstly the snorkel tube allows air in the vessel to escape as the vessel is filled with fluid through the air inlet tube and secondly the snorkel tube supports a column of fluid which forms a seal which prevents the entry of air into the vessel through the snorkel tube during operation of the device.

The snorkel tube is preferably a U-shaped tube passing into the vessel at a point above the upper filling level, extending downwardly into the vessel and bending upwardly towards the roof of the vessel. Preferably the inner end of the snorkel tube opens into the air space above the fluid inside the vessel. The outlet port is preferably of sufficient length that it can support a column of fluid of a height equal to the distance between the predetermined fluid level set by the air inlet tube and the maximum fill level of the vessel.

The snorkel tube may also be provided with a fluid outlet port to allow fluid to be drained from the snorkel tube prior to filling the vessel. The snorkel tube preferably extends from the bottom region of the snorkel tube to outside the vessel. The fluid in the snorkel tube may then be removed in a controlled manner through the outlet port by opening a valve located outside the vessel. Such an outlet port is especially suitable for use with harmful liquids since spraying and/or splashing of the liquid in the snorkel tube during filling is avoided.

A device fitted with a snorkel tube may be filled in situ without the need for rotation or inversion while filled with fluid.

One method of filling the vessel is to block the aperture leading to the fluid receptacle and then fill the vessel through the air inlet tube using a hose or other pressurized fluid source. The aperture may be blocked by a tap in the line connecting the device to the fluid receptacle, by a plug in the aperture or by any other suitable means.

The fluid pressure entering the vessel through the air inlet tube forces air and any trapped fluid around the snorkel tube until the vessel is full at which time fluid emerges from the snorkel tube. When the fluid supply is discontinued the fluid stays trapped in the snorkel tube forming an air tight seal. The aperture is then opened and the device functions as in the previous embodiment.

Another method of filling the vessel which is especially suitable if only a low pressure fluid supply is available is to empty the vessel by draining through the aperture and then emptying the snorkel tube. The snorkel tube may be emptied by suction, by blowing through the tube, by inverting the device or by opening the valve in the outlet port if one is provided. After emptying the snorkel tube fluid is poured into the vessel through the air inlet tube until the vessel is full and the seal in the snorkel tube is reestablished. A funnel may be used to facilitate filling the vessel through the air inlet tube, or in another embodiment of the invention, a portion of the upper surface or roof of the vessel is shaped so as to form a funnel leading down to the top of the air inlet tube.

While two methods of filling the device incorporating a snorkel tube have been described other methods would be evident to a person skilled in the art.

BRIEF DESCRIPTION OF THE DRAWINGS

It will be convenient to further describe the invention by reference to the accompanying drawings which illustrate some preferred embodiments of the invention. Other embodiments of the invention are possible and consequently the particularity of the accompanying drawings is not to be understood as superseding the generality of the preceding description of the invention.

DETAILED DESCRIPTION

Figure 1:
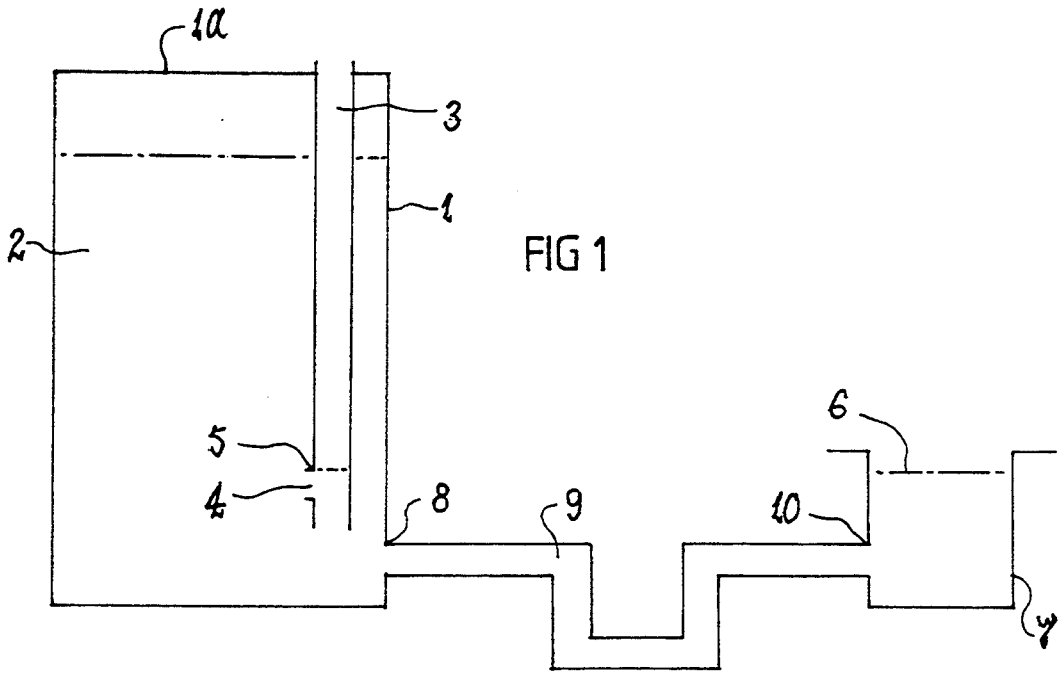
FIG. 1 is a diagrammatic representation of an embodiment of the invention incorporating an air inlet tube and a remote fluid receptacle.

Referring to FIG. 1 there is shown a closed vessel 1 containing a fluid supply 2. An air inlet tube 3 passes through the roof 1a of the vessel 1 into the interior of the vessel. The air inlet tube 3 has an opening 4 in its lower end, the uppermost portion of which 5 defining the fluid level 6 to be maintained in remote fluid receptacle 7.

Vessel 1 includes an aperture 8 located below opening 4 for allowing the fluid supply 2 to communicate with the fluid in the fluid receptacle. A hose 9 is connected to the aperture 8 via a hose connector (not shown). The other end of the hose is connected to an opening 10 near the bottom of fluid receptacle 7. The hose connector is not shown.

As fluid is removed from receptacle 7 air is drawn into the vessel 1 through opening 4 which allows fluid to pass from the vessel 1 into receptacle 7 until the fluid level is restored. When the fluid level is restored the opening 4 is blocked by the fluid in the vessel and the partial vacuum restored. This will continue until the fluid level in vessel 1 drops below 5. At this point the device would cease to function unless refilled.

The device may be refilled by disconnecting the hose 9 at aperture 8 or 10, rotating the vessel so that aperture 8 is on the top side and filling the vessel through the hose or aperture 8 until fluid begins to emerge from the air inlet tube 3. Alternatively the vessel may be filled through the air inlet tube 3 until fluid begins to emerge from aperture 8.

After refilling the vessel the vessel is carried in its rotated position to its operating location after which the hose 9 is reconnected and the device is rotated to the vertical. This causes fluid to flow through the hose 9 into the fluid receptacle 7 until the fluid receptacle is filled to the predetermined level 6 at which point the air inlet tube 3 becomes blocked at opening 4 by the fluid in the vessel.

Figure 2:
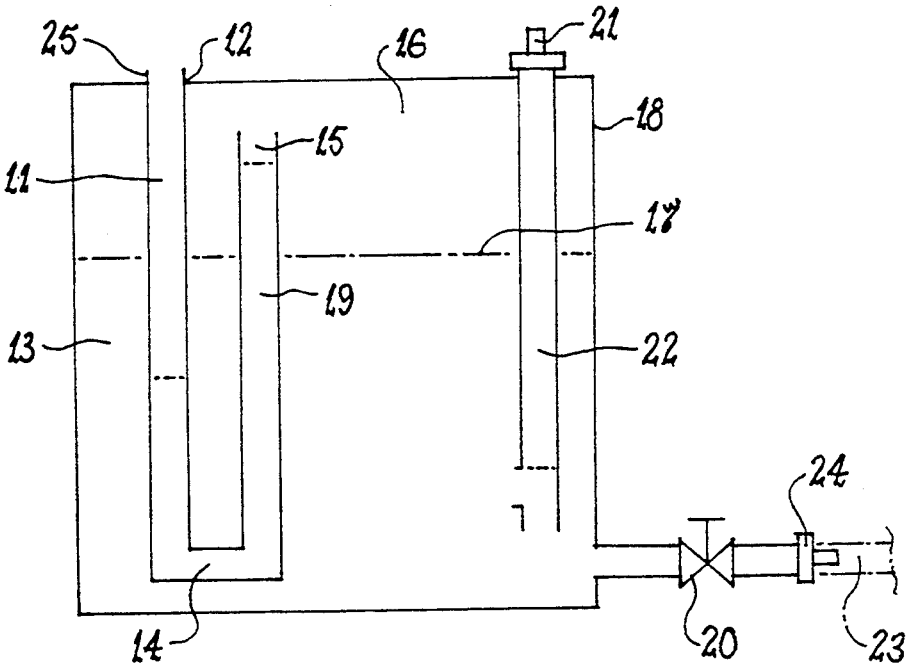
FIG. 2 is a diagrammatic representation of an embodiment of the invention including both an air inlet tube and a snorkel tube.

FIG. 2 shows a device according to the invention which is capable of being filled in situ without inversion or rotation. The device functions in exactly the same way as the device showed in FIG. 1. The device shown in FIG. 2 includes a U-shaped snorkel tube 11 extending from the roof of the vessel 12 into the interior of the vessel 13. The snorkel tube has a U-shaped bend 14 which results in the interior end of the snorkel tube 15 pointing upwards into the air space 16 above the fill level 17 of the vessel 18. The fluid 19 in the snorkel tube 11 acts to seal the vessel and allows the device to operate in the same way as the device shown in FIG. 1.

To refill the device shown in FIG. 2 with a hose, tap 20 is closed and a hose is connected to hose connector 21. The fluid entering the vessel through the air inlet tube 22 forces air and any trapped fluid out of the vessel through the snorkel tube 11 until the vessel is filled. After filling the hose is disconnected from connector 21 and tap 20 is opened to allow the fluid to flow into the fluid receptacle (not shown) through hose 23. The vessel 18 may also be refilled by disconnecting hose 23 at hose connector 24, opening tap 20 and allowing the fluid to drain out of the vessel. The snorkel tube 11 is then emptied by inverting the vessel or by blowing through the snorkel tube. Tap 20 is then closed, hose connector 21 is removed and fluid is poured into the air inlet tube 22 until sufficient fluid has entered the snorkel tube 11 at which point the vessel will be full. Alternatively the vessel may be filled to the desired level through the air inlet tube 22 and then the snorkel tube may be filled through end 25. After the vessel 18 is filled tap 20 is opened and fluid is allowed to flow through hose 23 into the fluid receptacle (not shown).

Figure 3:
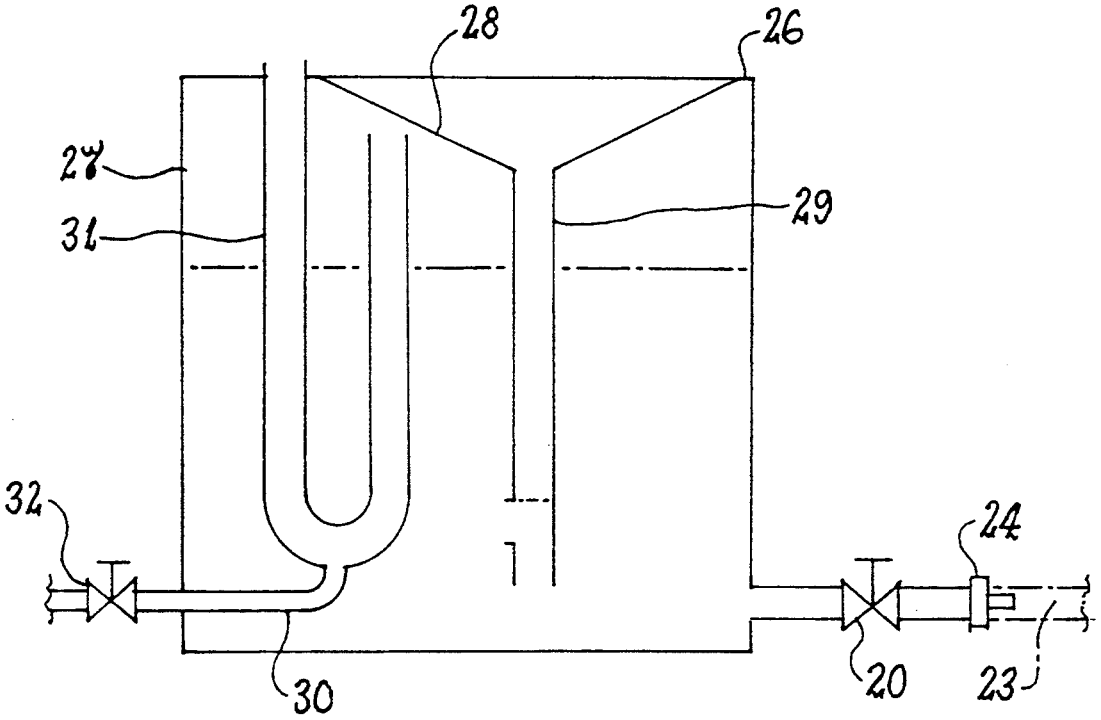
FIG. 3 is a diagrammatic representation of an embodiment of the invention in which the roof of the vessel is funnel shaped.

Referring to FIG. 3 there is shown a further embodiment of the invention in which the roof 26 of the vessel 27 is shaped to form a funnel 28 leading down to the top of air inlet tube 29 to facilitate filling of vessel 27. This embodiment also includes an outlet port 30 extending from the bottom of snorkel tube 31 to outlet valve 32 located outside vessel 27. This allows fluid to be drained from snorkel tube 31 in a controlled manner.

The device according to the invention may be manufactured and sold to be fitted to an existing fluid receptacle or the device and receptacle may be produced as a single unit or as a kit for assembly.

Finally it is to be understood that various alterations, modifications or additions may be introduced into the device of the present invention previously described without departing from the spirit or ambit of the invention.

I claim:

1. A device for restoring a fluid level in a fluid receptable to a predetermined level when said fluid level falls below said predetermined level, said device comprising:

a closed vessel for containing a fluid supply, said vessel having an aperture allowing said fluid supply to be in communication with fluid in said fluid receptacle, and an air inlet tube extending into said vessel having an inlet open to the atmosphere outside the vessel and an outlet open to the inside of the vessel, wherein in use, the device is positioned relative to the receptacle so that an uppermost portion of the outlet is at said predetermined level such that air is drawn into the vessel when said level in the fluid receptacle falls below said predetermined level thereby allowing fluid to pass through the aperture into the fluid receptacle until the fluid level is restored.

2. A device according to claim 1 wherein said air inlet tube terminates in a downwardly extending portion having an open end providing said outlet.

3. A device according to claim 1 wherein said outlet is located in the side of a downwardly extending portion of the air inlet tube.

4. A device according to claim 1 further comprising a snorkel tube which allows air in the vessel to escape as the vessel is being filled with fluid and which supports a column of fluid forming a seal which prevents entry of air into the vessel through the snorkel tube during operation of the device.

5. A device according to claim 4 wherein said snorkel tube comprises a generally U-shaped tube having one end open to the atmosphere outside the vessel, the other end open to the inside of the vessel.

6. A device according to claim 5 wherein said U-shaped tube includes a fluid outlet port allowing fluid to be drained from the U-shaped tube.

7. A device according to claim 4 wherein said vessel includes a roof having a funnel shaped portion, a bottom of the funnel shaped portion coinciding with a top of the air inlet tube to facilitate filling the vessel through the air inlet tube.

8. A device according to claim 1 wherein said aperture is adapted for receiving an end of a length of conduit to form an air tight connection therewith, the other end of said conduit being connectable to said fluid receptacle, thereby allowing the device to be located remote from said fluid receptacle.

* * * * *